United States Patent [19]

Ramsay

[11] 3,980,213

[45] Sept. 14, 1976

[54] COVERS FOR PAINT CANS

[75] Inventor: Richard A. Ramsay, Babylon, N.Y.

[73] Assignee: Three Dimensional Circuits, Inc., Plainview, N.Y.

[22] Filed: Sept. 12, 1974

[21] Appl. No.: 505,442

Related U.S. Application Data

[63] Continuation-in-part of Ser. No. 369,380, June 12, 1973, abandoned.

[52] U.S. Cl. ..... 222/485; 222/570; 220/85 SP; 220/90

[51] Int. Cl.[2] ..... B65D 25/48

[58] Field of Search ..... 222/478, 481, 482, 484, 222/545, 566, 567, 569, 570, 485; 220/85 SP, 90

[56] References Cited

UNITED STATES PATENTS

| | | | |
|---|---|---|---|
| 2,786,614 | 3/1957 | Giusto | 222/570 |
| 2,873,052 | 2/1959 | Atherton | 222/570 |
| 2,945,611 | 7/1960 | Weiffenbach | 220/90 X |
| 2,945,612 | 7/1960 | Weiffenbach | 220/90 |
| 3,245,565 | 4/1966 | Zeppenfeld et al. | 222/567 X |
| 3,303,971 | 2/1967 | Stevens | 222/484 X |
| 3,329,307 | 7/1967 | Jacobson | 220/90 |

*Primary Examiner*—Stanley H. Tollberg
*Assistant Examiner*—Joseph J. Rolla
*Attorney, Agent, or Firm*—Burgess, Dinklage & Sprung

[57] ABSTRACT

A cover for an open paint can having a rim about its top, the cover comprising a peripheral lower portion adapted snugly to engage the rim of the top of the paint can. The cover is provided approximately centrally thereof with a brush opening having at least one straight edge defined by a wall raised relative the adjacent area of the cover. The cover is provided wih an arcuate raised pouring lip at one area along its periphery and with an arcuately bounded opening located adjacent the lip. The top surface of the cover may be inclined or dished so that paint thereon will drain to the lowest point from which it will fall back into the paint can. The cover may be fixed to a paint can and another member of different design may be affixed to the bottom of the paint can, the member simultaneously serving as a closure for a can therebelow to permit stacking. Advantageously a removable sealing member is provided, having two portions for closing the brush and pouring openings so that once the cover is placed on the can it may be left permanently thereon and only the sealing member is removed and replaced.

4 Claims, 12 Drawing Figures

COVERS FOR PAINT CANS

This application is a continuation-in-part of application Ser. No. 369,380, filed June 12, 1973, now abandoned.

The present invention relates to covers for paint cans which may serve as pouring spouts, brush wipers and can closures.

In painting it is customary to dip a brush into a paint can and to wipe the brush against the side of the can to remove excess paint to prevent its running down the brush handle during use. The brush face is straight while the can is circular so obviously the wiping action is not uniform across the brush face. To remove enough paint from the middle to prevent later running of paint, obviously the sides of the brush will have too much paint removed. Moreover, wiping results in some paint running down the outside of the paint can with staining of the support surface.

It is accordingly an object of the invention to provide means for wiping a paint brush evenly across its face without running down the outside of the paint can.

It is another object of the invention to provide several different wiping edges on a single cover to permit different wiping actions.

A further object of the invention is to provide means for neatly pouring off paint from a paint can without dripping.

Still another object is to provide a means for storing the can and attached wiping means in a manner which permits their ready use as a later time.

These and other objects and advantages are realized in accordance with the present invention pursuant to which there is provided a cover for an open paint can having a rim about its top, comprising a peripheral lower portion adapted snugly to engage the rim of the top of the paint can, said cover being provided approximately centrally thereof with a brush opening having at least one straight edge defined by a wall raised relative the adjacent area of said cover. The cover is further provided with an arcuate pouring lip at one area along its periphery and with an arcuately bounded opening located adjacent said lip.

The upper surface of the cover may be dished or slightly conical so paint on the top will advance toward the brush opening or it may be planar but inclined downwardly toward the pouring lip for paint run-off. The lip is contoured to prevent dead spots where paint can accumulate without run-off. Advantageously, there is a barrier opposite the pouring lip to limit the size of the pouring opening and thus control the pouring.

Desirably, a removable sealing member is provided to close off the brush opening and the pouring opening when it is desired to store the can and paint, so that the cover can be left on during such storage. Thereafter it is necessary only to remove and replace the sealing member before and after each period of use.

The cover of course is intended for use in conjunction with a conventional paint can which has a peripheral depending skirt about its bottom. For use with the paint can the invention also provides a base which can engage the bottom of the paint can and thus keep the paint can off the floor, or the base can be fit over the open top of a second paint can and thus permit stacking, the base serving as the bottom support for the first paint can and a top closure for the second paint can.

The invention will be further described with reference to the accompanying drawings wherein.

Figure 5:
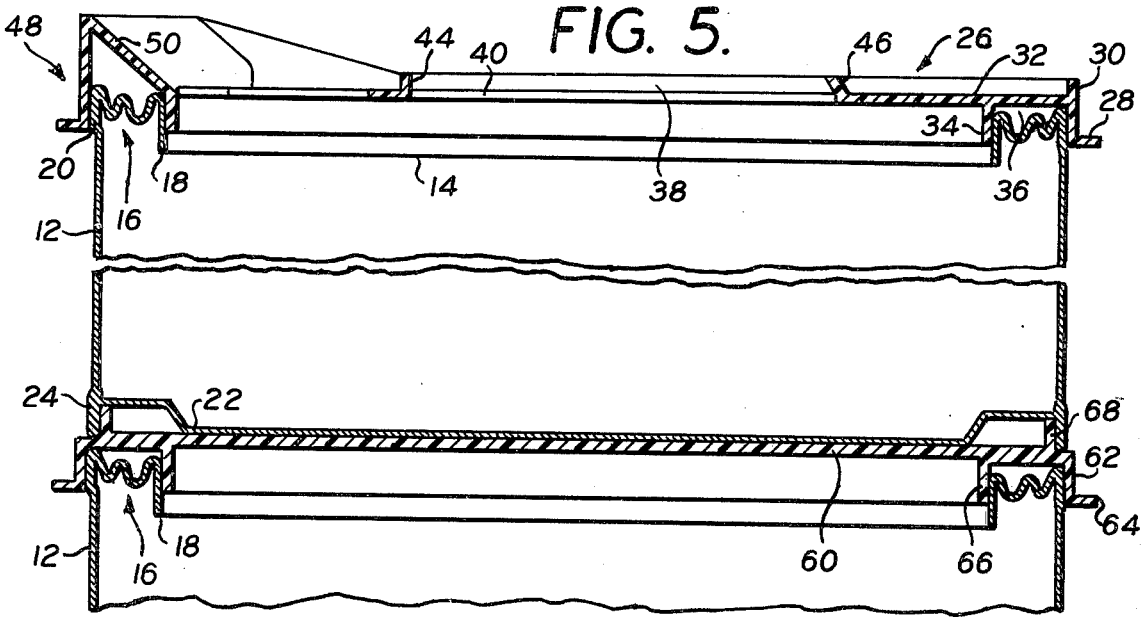
FIG. 5 is a vertical section through an assembly of two stacked paint cans, one base serving as a bottom support for the upper can and a top closure for the lower can, and a cover on the upper can.

Referring now more particularly to the drawings, in FIG. 5 there is shown a conventional one-gallon paint can 12 whose open mouth 14 is surrounded by an annular pleated rim 16 including inner wall 18 and outer wall 20. The can 12 also has a bottom 22 which is dished so that the bottom is bounded by a peripheral depending skirt 24.

Figure 1:
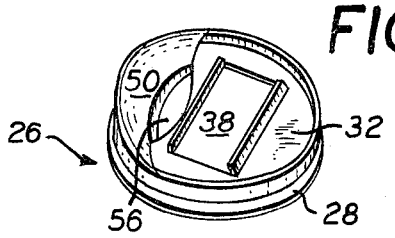
FIG. 1 is a perspective view of one paint can cover in accordance with the invention.
Figure 3:
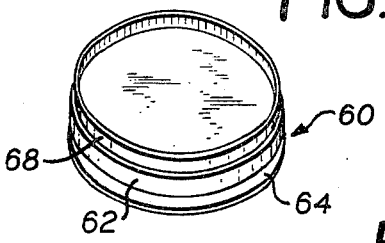
FIG. 3 is a perspective view of a paint can base in accordance with the invention.
Figure 2:
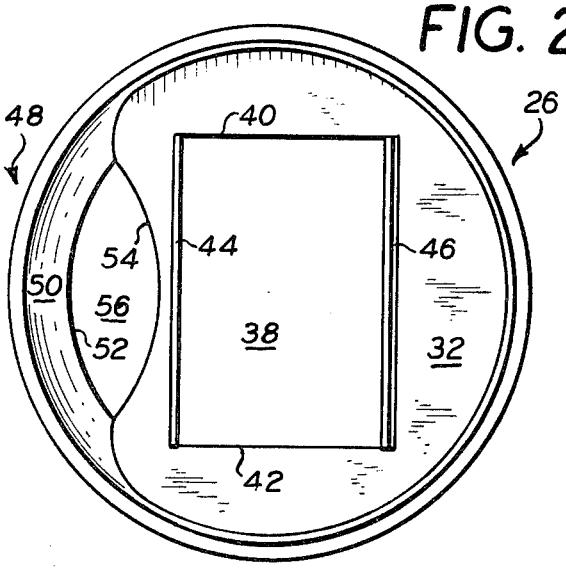
FIG. 2 is a top plan view of the cover of FIG. 1.
Figure 4:
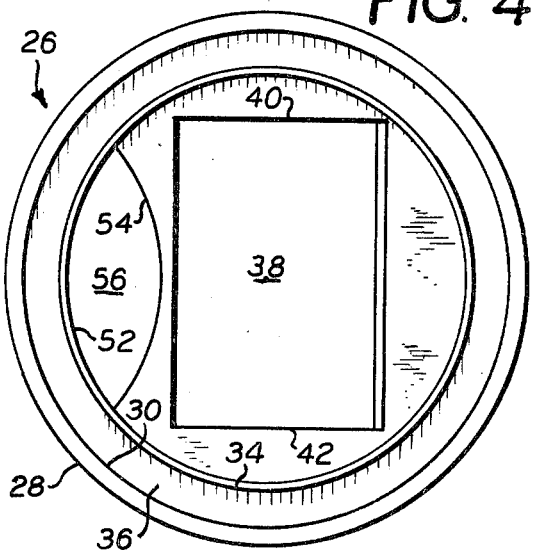
FIG. 4 is a bottom plan view of the cover of FIGS. 1 and 2.

A cover 26 is secured to the paint can 12, the cover comprising a short peripheral flange 28 which serves for strengthening and manipulation. The flange 28 is integral with a circular peripheral wall 30 which rises above the general plane 32 of the cover. Another circular peripheral wall 34 (FIG. 4) also depends downwardly from plane 32 to the same extent as wall 30 and with it defines an annulus 36 which is of such dimension that rim 16 fits tightly therein.

The cover 26 is provided with a rectangular opening 38. Two edges of the opening, 40 and 42, are flush with the plane 32 of the cover so that any paint on the cover will be able to run down into the can through the opening. The other two edges, 44 and 46, are raised above the plane 32 to form special brush wiping edges. Thus edge 44 is substantially vertical whereas edge 46 is inclined or undercut. Which of the four edges the painter uses for wiping will depend upon the size of the brush, its stiffness, the consistency of the paint or other liquid in the can and the painter's personal preference.

Adjacent one of the long edges of opening 38 the cover is provided with an arcuate pouring lip 48 whose outside is an integral extension of wall 30. The lip 48 has an inclined surface 50 which intersects plane 32 along an arc 52 which, together with an arc 54, defines a pouring opening 56. By tipping the can its contents can be readily poured out the opening 56 over lip 48. By restoring the can to upright position any paint on the lip 48 will run back down into the can through opening 56. The lateral extremities of lip 48 are so contoured that they will not provide any dead areas in which paint can accumulate without running back down into the can through either opening 38 or 56.

Figure 7:
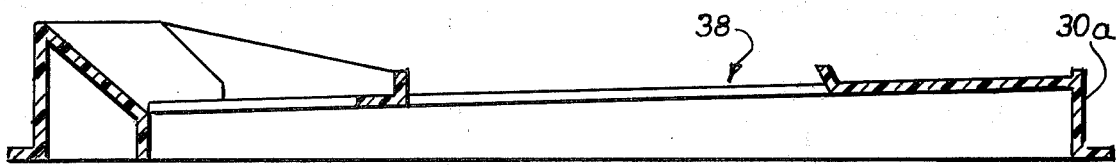
FIG. 7 is a vertical section through another embodiment of a cover.

In FIG. 7 there is shown another embodiment of cover in which the height of wall 30*a* is not uniform but rather is a maximum diametrically opposite lip 48. In this fashion plane 32 is inclined rather than being horizontal so that any paint on the cover will always tend to run down toward opening 56 at the lowest point on plane 32. In this embodiment it is not necessary that edges 40 and/or 42 be flush with plane 32.

Figure 8:
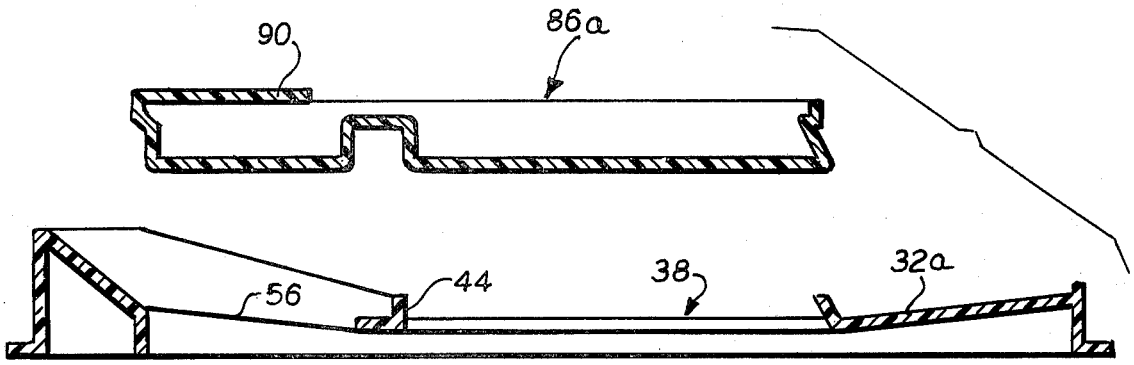
FIG. 8 is a vertical section through still another embodiment of a cover and mating sealing member.

In another embodiment shown in FIG. 8, the surface 32*a* is not planar but rather dished or slightly conical so that any paint thereon will tend to run to the middle where it will run down through. A sealing member is matched to the cover as will be described hereinbelow.

Figure 9:
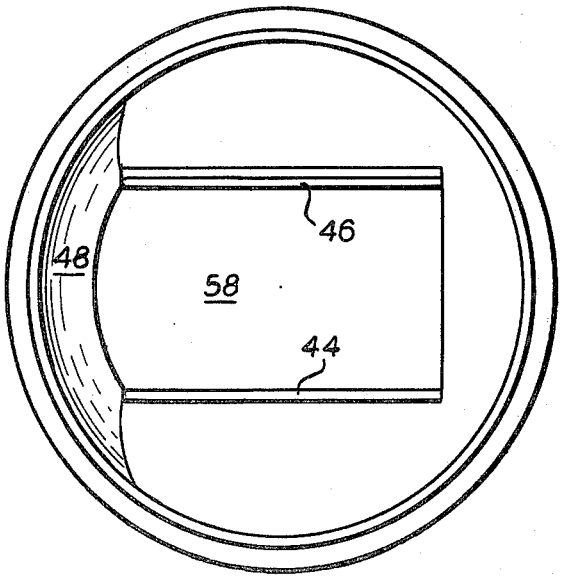
FIG. 9 is a top plan view of still another embodiment of a cover.

In still another embodiment shown in FIG. 9, the lip 48 is positioned between the raised edges 44 and 46 and the openings 38 and 56 have been joined into one at 58. This is slightly less preferred since it does not define as precisely as the others straight limits for the sides of the brush which limits contribute to an even wiping across the full width of the brush. Uneven wiping contributes to the tendency of paint to run down the brush handle in use because insufficient paint is removed from some portions.

Returning to FIG. 5, the bottom 22 of can 12 seats on a circular base 60 which is bounded by a wall 62 terminating in a short flange 64. The diameter of wall 62 is the same as that of wall 30 of cover 26 so that base 60 can fit snugly over the open mouth 14 of another paint can. To ensure an even tighter fit, base 60 is provided with an inner wall 66 of the same diameter as wall 34 of cover 26 so that rim 16 will be held between walls 62, 66 in the same fashion it is at other times held between walls 30, 34 of a cover. The base 60 is also provided with an upstanding wall 68 of such diameter and height that it mates with depending skirt 24 of the bottom 22 of paint can 26. The wall 68 may be inside (as shown) or outside skirt 24.

The base 60 may be used as shown to permit secure sealing and stacking of opened paint cans, the topmost one of which carries a brush-wiping opening. Alternatively, when painting is finished the cover 26 may be removed and replaced by a base 60 for sealing and storage. In such event there still may be another base 60 on the bottom of the paint can to raise the can off the floor and thus prevent rusting as might occur if the floor were wet.

Figure 6:
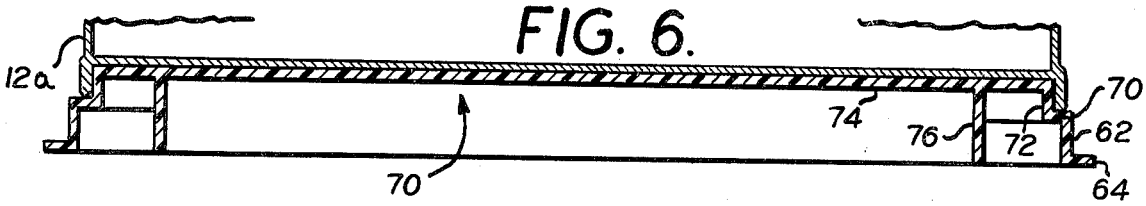
FIG. 6 is a vertical section through another embodiment of a base.

In FIG. 6 there is shown an alternate base 70 which is of the same general dimensions but which can be used with a can 12*a* whose bottom is higher than the end of skirt 24. Thus, the flange 64 projects from a wall 62 but the latter terminates in an annular ring 70 which is surmounted by a further wall 72 which ends in a surface 74 from whose underside an inner wall 76 depends.

The top surface of the base can be differently shaped to conform to the bottoms of paint cans of different structure. Alternatively, a base can be used which does not precisely conform in which case a second paint can may be stacked on top although the interfit will be less secure.

Figure 10:
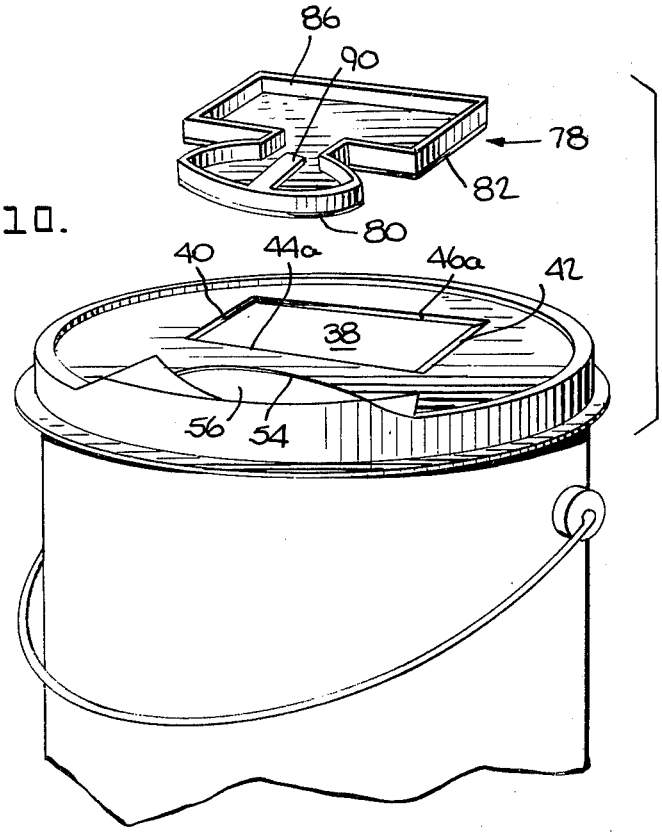
FIG. 10 is an exploded perspective view of a can carrying a modified cover along with a removable sealing member for the cover.
Figure 11:
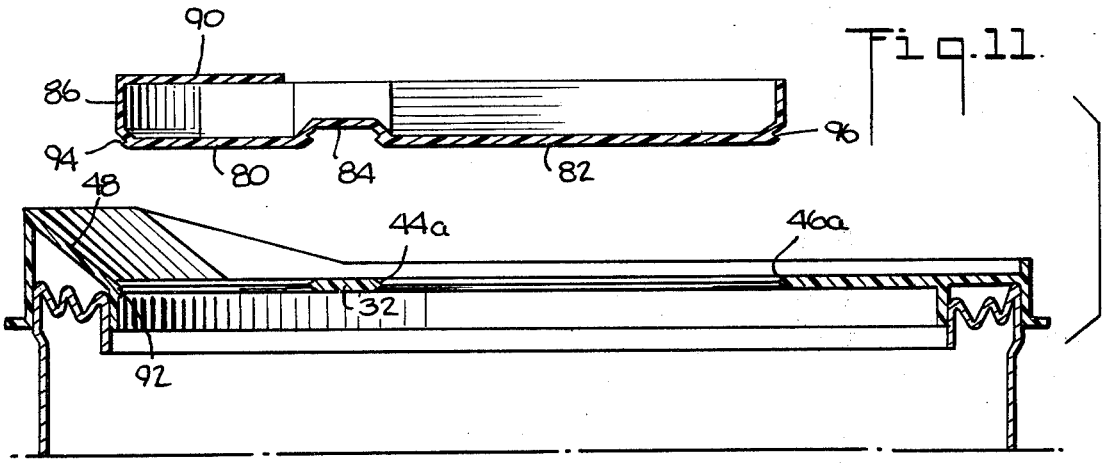
FIG. 11 is a vertical section through the can, cover and sealing member of FIG. 10.
Figure 12:
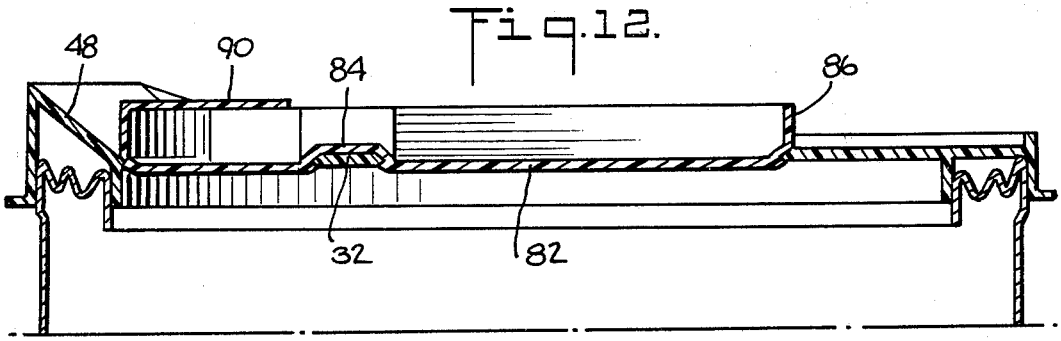
FIG. 12 is a view similar to FIG. 11 except that the sealing member is shown in operative position.

If after use all the paint is not used up, the can obviously cannot be directly stored since the openings in the cover permit the possibility of a paint spill if the can is jostled, the possibility of foreign bodies falling into the paint and, most important, hardening of the unused paint. Accordingly, FIGS. 10 to 12 show a special sealing member 78 comprising two portions 80 and 82 conforming in shape to openings 56 and 38, respectively, and joined by a raised horizontal connecting portion 84. Member 78 is surrounded by a raised peripheral wall 86 which at one area carries a pull tab 90; this tab can be formed by the plastic in the sprue line through which molten plastic is injected into the mold to form member 78 where injection molding is used.

In these figures the opening 38 has two lateral flush edges 40, 42 as before but the forward and rear edges 44*a*, 46*a* are also flush, rather than raised. In addition, lip 48 is provided with a projection 92 opposite to and merging with arc 54. The portions 80 and 82 are respectively provided with peripheral notches 94, 96.

When it is desired to interrupt painting and paint is left in the can, the brush is wiped as clean as possible and then washed in conventional manner. Sealing member 78 is then placed over the cover with portions 80, 82 in registry with openings 38, 56 and force is applied to the top of member 78 so that the projection 92 and arc 54 enter notch 94 of portion 80 while edges 40, 42, 44 and 46 enter notch 96 of portion 82, forming a seal. The horizontal connecting portion 84 contacts the plane 32 and prevents the sealing member 78 from being pressed so far into the can that it falls through the openings. When it is desired to unseal the can, the user pulls on tab 90 to disengage the notch 94 of portion 80 from projection 92 and arc 54 and this then gives greater leverage for a similar disengagement between portion 82 and the engaging elements bounding opening 38.

A reasonably tight seal can be achieved by friction alone even without notches 94 and 96, without projection 92 and even if walls 44a, 46a are raised as at 44 and 46. In such event, however, it is preferred that peripheral wall 80 is flared outwardly in upward direction, particularly around portions 80 and 82 so as to help form the tight seal as member 78 is forced downward. In FIG. 8 the opening 38 on its rear edge is bounded by an upstanding inclined lip 46 which therefore places special requirements on the sealing member whose wall 86*a* (contrasted with wall 86 of FIG. 11) has a correspondingly inclined portion. The upper part of wall 86*a* is contoured to prevent the sealing member from being pushed too far into either opening 38 or 56.

If desired, the portions 80 and 82 can be independent of one another although preferably they are integral, as shown.

The various covers and bases described herein are preferably integral single piece constructions, molded from plastic compositions into somewhat elastic shapes although they can even be impregnated cardboard. If the moldings are stiff they cannot readily be distended frequently to be put on or taken off the paint can. If too soft, they will not afford a stiff enough surface for wiping the paint brush and removal from the paint can will be difficult. The proper consistency is a composite of the chemical composition, its thickness and design of suitable reinforcements.

Especially suitable materials are the high density polyolefins, polyethylene and polypropylene. Not only are they inexpensive and easy to work with but they have the desired physical properties and are not attacked by either water or oil-based paints, as are many other plastics. Other plastics which can also be employed include nylon, polyacetyl, acrylonitrile-butadiene-styrene terpolymer, and the like.

The sealing members can be formed of these same materials or they can be quite elastic since that facilitates their insertion and removal.

It will be appreciated that the instant specification is set forth by way of illustration and not limitation, and that various modifications and changes may be made without departing from the spirit and scope of the present invention.

What is claimed is:

1. Covering means for an open paint can having a rim about its top, said covering means comprising a cover and sealing means therefor, said cover comprising a generally planar surface having a peripheral lower portion depending therefrom and adapted to snugly engage the rim of the top of the paint can, said cover being provided approximately centrally of said surface with a brush opening having a pair of parallel straight edges defined by walls extending up from said surface for wiping both faces of a brush moved back and forth in said brush opening, one of said walls being undercut whereby paint thereby wiped off a brush will flow back into said paint can, said cover being further provided with an arcuate raised pouring lip at one area along the periphery of said surface and with an arcuate bounded pouring opening leading to said lip, said cover being contoured in its upper surface so that any paint thereon will flow by gravity toward and into said brush opening and said pouring opening, said sealing means having a generally planar first portion conforming in contour to said brush opening, a second planar portion conforming to said pouring opening, and a peripheral wall about said first and second portions for contact with the edges of said openings, removal of said wall from said openings permitting access to the inside of said can.

2. Covering means according to claim 1, said sealing means including a connecting portion permanently securing said first-named planar portion to said second planar portion, and a pull tab on said peripheral wall for initiating removal of said wall from an opening.

3. Covering means according to claim 2, wherein said brush opening is rectangular, the lateral edges of said opening limiting the lateral widening of a brush during wiping.

4. Covering means according to claim 3, wherein said cover is of unitary integral configuration molded of polyolefin.

* * * * *